United States Patent [19]

Laucis et al.

[11] Patent Number: 4,480,749

[45] Date of Patent: Nov. 6, 1984

[54] TAMPER-EVIDENT CONTAINER AND METHOD FOR MAKING THE SAME

[75] Inventors: Peter K. Laucis, Lilburn; Robert Terry, Norcross, both of Ga.

[73] Assignee: Nordson Corporation, Amherst, Ohio

[21] Appl. No.: 498,280

[22] Filed: May 26, 1983

[51] Int. Cl.[3] ..... B65D 85/56

[52] U.S. Cl. ..... 206/459; 206/807; 215/230; 116/207; 116/216

[58] Field of Search ..... 206/459, 807; 215/230; 116/203, 206, 207, 216

[56] References Cited

U.S. PATENT DOCUMENTS

| | | | |
|---|---|---|---|
| 3,615,005 | 10/1971 | Segel et al. | 206/459 |
| 3,616,898 | 11/1971 | Massie | 206/459 |
| 3,715,856 | 2/1973 | Borel | 206/459 |
| 3,952,869 | 4/1976 | Sansom | 206/807 |
| 4,091,921 | 5/1978 | Lewis | 206/459 |
| 4,121,714 | 10/1978 | Daly et al. | 206/459 |
| 4,145,918 | 3/1979 | Couch et al. | 206/459 |
| 4,165,002 | 8/1979 | Meagher | 206/459 |
| 4,197,947 | 4/1980 | Zaidi | 206/459 |
| 4,424,911 | 1/1984 | Resnick | 206/459 |
| 4,449,631 | 5/1984 | Lavenberg et al. | 206/807 |

*Primary Examiner*—Joseph Man-Fu Moy

*Attorney, Agent, or Firm*—Michael L. Gill; Stephen T. Belsheim

[57] ABSTRACT

A tamper-evident container and a method for making the same. The container includes at least one open end with integral flaps adjacent the open end. A thermoplastic material is applied to one flap with the other flap folded over onto the one flap. The flaps are thus sealed together with a thermoplastic material. A temperature-sensitive indicator is applied to the closed end so that the indicator visually indicates whether an excessive amount of heat has been applied to the seal of thermoplastic material.

7 Claims, 5 Drawing Figures

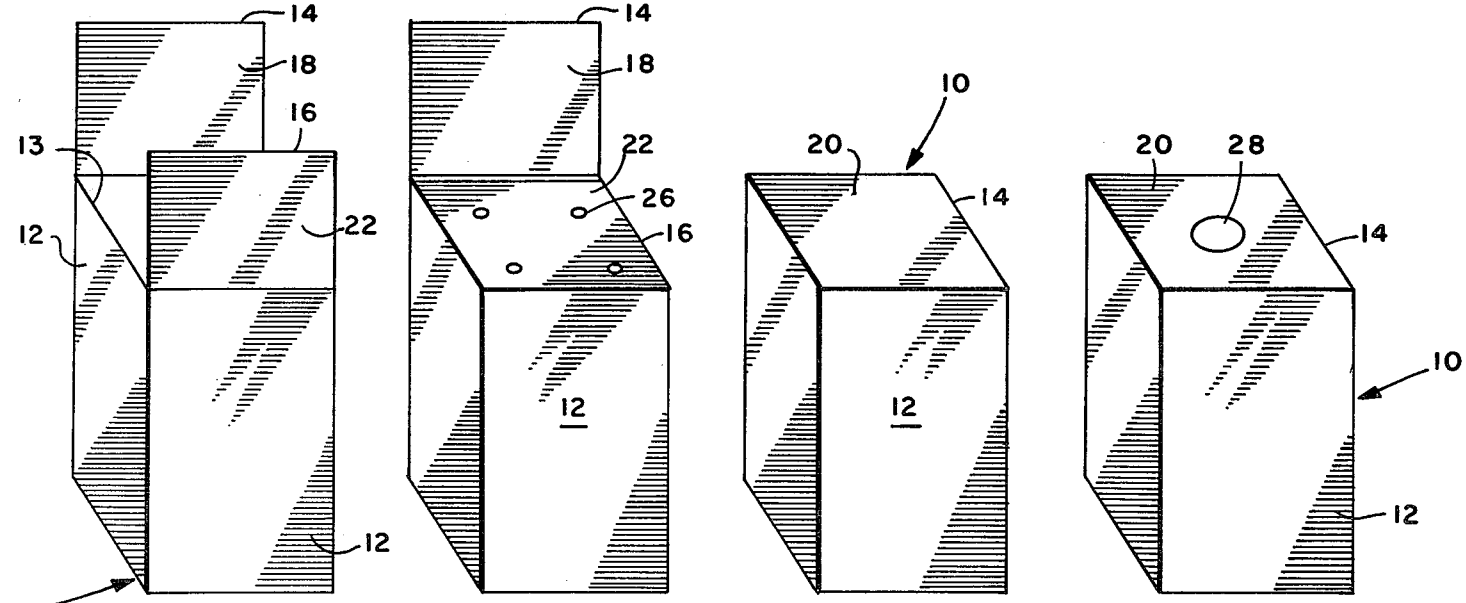
FIG. 1D
FIG. 1C
FIG. 1B
FIG. 1A
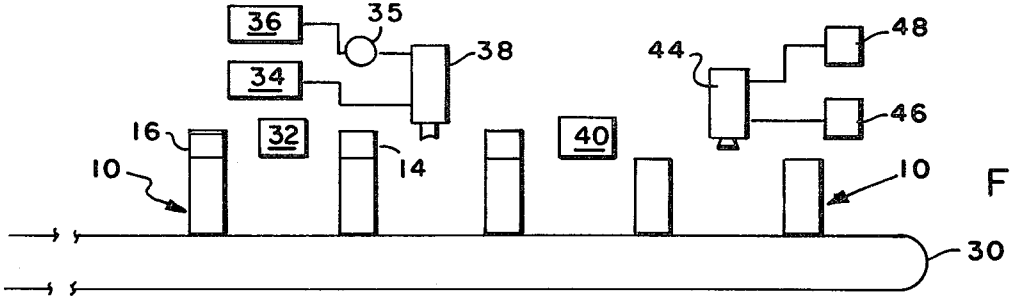
FIG. 2

TAMPER-EVIDENT CONTAINER AND METHOD FOR MAKING THE SAME

BACKGROUND OF THE INVENTION

In view of the poisioning of several persons living in the Chicago area after taking Extra-Strength Tylenol capsules, manufacturers of over-the-counter (O-T-C) drug have become very concerned that their products are tamper-evident or tamper-resistant, as the case may be. In an effort to address this problem, these manufacturers have looked to a number of different ways to make their products either tamper-resistant or tamper-evident.

Many O-T-C drugs are contained in bottles which are themselves contained within a heavy paper or lightweight cardboard box. One way to make the box tamper-evident is to seal the opposite ends of the box so that any opening of the box is evident. For example, the opposite ends of the box can be sealed with a drop or line pattern bead of thermoplastic material such as hot melt adhesive.

It was initially thought that sealing both ends of the box with a hot melt adhesive would render the package tamper-evident or tamper-resistant. Such a seal still renders the package tamper-resistant, i.e., resistant to tampering. However, it appears that when low temperature hot melt adhesives are used, the seal may sometimes be defeated by using a hair dryer or the like to reheat or reactivate the hot melt adhesive thereby facilitating the undetected opening or resealing of the box. In order to perform such an action, the tamperer would, of course, have to be both very careful and possess means to heat the hot melt equipment. In the case of high performance hot melt adhesives which melt at temperatures above 400° F. or thermoset materials, the reheating of these materials would either destroy the box or be impossible, respectively.

It is thus apparent that it would be desirable to provide an improved tamper-evident package having an external box sealed by low temperature hot melt adhesives.

SUMMARY OF THE INVENTION

The invention relates to a tamper-evident container and a method for making such a container. The container includes a body with opposite open ends. Each open end includes a plurality of integral flaps sealed together with a thermoplastic material. A temperature-sensitive indicator is located on the flap adjacent the location where the flaps are sealed so that the indicator visually indicates whether an excessive amount of heat has been applied to the seal of thermoplastic material.

The method of making a tamper-evident container comprises the following steps. First, taking a container with flaps adjacent the open ends thereof. Second, folding one of the flaps over the open end. Third, applying molten thermoplastic material to the external surface of the folded flap. Fourth, folding the other flap over the folded flap so that the flaps are sealed. Fifth, applying a thermally-sensitive indicator to the closed end so that the indicator visually indicates whether an excessive amount of heat has been applied to the seal of thermoplastic material.

BRIEF DESCRIPTION OF THE DRAWINGS

These and other objects and advantages of the invention will become apparent to those skilled in the art from the following detailed description of a preferred embodiment when considered in conjunction with the accompanying drawings.

FIGS. 1A through 1D are perspective views of a container illustrating the forming a tamper-evident closure at one end thereof; and FIG. 2 is a schematic view of a manufacturing line which makes the container illustrated in FIGS. 1A–1D.

DETAILED DESCRIPTION OF A SPECIFIC EMBODIMENT

Referring to FIGS. 1A through 1D, the container is generally designated as 10. Container 10 can be made out of a heavyweight paper or a lightweight cardboard. Generally, another container, such as a bottle, filled with product is inserted within the container. Container 10 illustrated in the drawings already has a bottle (not illustrated) inserted therein.

Container 10 includes four sidewalls 12 and a top end 13. Container 10 has a pair of integral flaps 14 and 16 extending from the top end thereof. One flap 14 is longer than the other flap 16.

Flaps 14 and 16 are initially open so as to allow a product, or another container containing product, to be deposited within container 10. After the product is inserted, the shorter flap 16 is folded over the opening. Conventional flap folding machinery will adequately accomplish this task.

After flap 16 is folded one or more beads of a molten thermoplastic material 26 (e.g. hot melt adhesive) are applied to the exterior surface 22 of flap 16. The hot melt adhesive 26 is deposited by a hot melt adhesive gun 38 connected to a hot melt adhesive application unit 34. Gun 38 is connected through solenoid valve 35 to an air supply 36. A commercially available timer arrangement (not illustrated) is also used to make sure the adhesive is deposited at the proper time. The above-described assembly of equipment is commercially available from Nordson Corporation of Amherst, Ohio. For example, the hot melt adhesive gun may be the Nordson Model H-20 or H-200 gun. The application unit may be the Nordson Model 2000 unit. The timing arrangement may include the Nordson Model PC-10.

Once the adhesive has been applied, the longer flap 14 is folded over flap 16 so that the interior surface 18 of flap 14 contacts the hot melt adhesive deposited on exterior surface 22 of flap 16. The end result is that top end 13 of container 10 is sealed closed. Again, conventional flap folding machinery will adequately accomplish this task.

Finally, a temperature-sensitive liquid 28, such as that available from Big Three Industries, Inc., Tempril Division, Hamilton Boulevard, South Plainfield, N.J. 07080, is sprayed on exterior surface 20 of longer flap 14 so as to be proximate the deposits of hot melt adhesive. The heat sensitive liquid is formulated so that it will change from one distinctive color to another at a temperature of no less than 150° F. The color change will be irreversible.

Thus, the liquid will be one distinctive color (e.g. green) when sprayed onto the container at room temperature. But when the liquid is exposed to a certain amount of heat, it will irreversibly change to another distinctive color (e.g. red). The liquid is sprayed by a spray gun 44 such as the Nordson Model AD-29 made and sold by Nordson Corporation of Amherst, Ohio 44001. Spray gun 44 is connected to a liquid source 46 and an air supply 48.

It is now apparent that if someone attempts to tamper with container 10 by applying heat to the solidified deposit of hot melt adhesive, the temperature-sensitive liquid will irreversibly change color thereby giving a visual warning that someone has attempted or actually tampered with container 10.

While we have disclosed specific embodiments of our invention, persons skilled in the art to which this invention pertains will readily appreciate changes and modifications which may be made in the invention. Therefore, we do not intend to be limited except by the scope of the following appended claims.

What is claimed is:

1. A tamper-evident container comprising:

a container body defining opposite open ends, a plurality of integral flaps extending from each open end, said flaps being sealed together with a thermoplastic material so as to close both open ends of the container; and a temperature sensitive indicator being on the exterior surface of each closed end so that said indicator visually indicates whether an excessive amount of heat has been applied to the seal of thermoplastic material.

2. The container of claim 1 wherein said indicator comprises a deposit of temperature sensitive liquid, said liquid irreversibly changing color from a first to a second color upon being placed at or above a first temperature.

3. The container of claim 2 wherein the thermoplastic material melts at a temperature higher than said first temperature.

4. A method for sealing an open end of a container having a pair of upstanding integral flaps, the method comprising the steps of:

folding one of the flaps over the open end;

applying molten thermoplastic material to the exterior surface of said one flap;

folding the other flap over said one flap so that the interior surface of said other flap contacts said thermoplastic material thereby closing the open end of the container; and applying a temperature-sensitive indicator to the exterior surface of said other flap so that said indicator visually indicates whether an excessive amount of heat has been applied to the seal of thermoplastic material.

5. The method of claim 4 wherein said indicator comprises a deposit of temperature sensitive liquid, said liquid irreversibly changing color from a first to a second color upon being placed at or above a first temperature.

6. The method of claim 5 wherein the thermoplastic material melts at a temperature higher than said first temperature.

7. A tamper-evident container comprising:

a container body defining opposite open ends, a plurality of integral flaps extending from each open end, said flaps being sealed together with a thermoplastic material so as to close both open ends of the container; and a temperature sensitive indicator at each closed end being proximate to the seal of the thermoplastic material so that said indicator visually indicates whether an excessive amount of heat has been applied to the seal of thermoplastic material.

* * * * *